United States Patent [19]

Peterson

[11] 3,933,402

[45] Jan. 20, 1976

[54] DRAWER WITH REMOVABLE FRONT PANEL

[75] Inventor: Warren J. Peterson, Stevens Point, Wis.

[73] Assignee: Joerns Furniture Company, Stevens Point, Wis.

[22] Filed: July 15, 1974

[21] Appl. No.: 488,507

[52] U.S. Cl. ..... 312/330; 312/214

[51] Int. Cl.[2] ..... A47B 88/00

[58] Field of Search ..... 312/195, 214, 263, 330, 312/216–218

[56] References Cited

UNITED STATES PATENTS

| | | | |
|---|---|---|---|
| 3,318,646 | 5/1967 | Ibel | 312/218 |
| 3,511,549 | 5/1970 | Macaluso | 312/219 |
| 3,582,174 | 6/1971 | Riley | 312/330 |
| 3,752,553 | 8/1973 | Bildahl et al. | 312/330 |

*Primary Examiner*—Casmir A. Nunberg
*Attorney, Agent, or Firm*—Price, Heneveld, Huizenga & Cooper

[57] ABSTRACT

A drawer utilizes a front panel that is removably secured to the front of a drawer pan. Fasteners on the rear portion of the front panel cooperate with mounting means on the front of the drawer pan to rapidly and invisibly secure the front panel onto the drawer pan.

13 Claims, 6 Drawing Figures

DRAWER WITH REMOVABLE FRONT PANEL

BACKGROUND OF THE INVENTION

The drawer assembly of this invention relates to removable drawer assemblies.

When it has been necessary to clean drawers by full immersion, e.g., in hospitals, laboratories, etc., it has been the practice to utilize a drawer which is able to withstand immersion cleansing without deterioration. Such drawers have been one-piece, either stainless steel or plastic, which may be totally immersed in a cleansing solution. These drawers, though highly functional in nature, may not comprise any deteriorable materials in their front panels for decorative purposes, since such materials, e.g., wood, may not be readily cleansed by immersion without deterioration.

In instances where it has been desired to rearrange decorative front panels of drawers, some prior art drawers attach decorative frontings to drawer pans which are removable. However, these frontings are usually screwmounted to the drawer pan and require great time and effort to remove and thus are not suitable for uses which require frequent immersion type cleaning of the drawer pan. Further, these drawers are not able to withstand continual assembly and disassembly without excessive wear on the assembly components. Also, such drawers normally require matching of components before reassembly.

SUMMARY OF THE INVENTION

The drawer of this invention utilizes a drawer pan having a mounting means for mounting a panel on its front and a front panel which is removably secured on the mounting means by a fastening means. The fastening means is invisible from the front side of the panel. The fastening means includes a plate member secured to the rear of the panel and a latch member mounted on and removable with respect to the plate member which slidably engages the mounting means on the drawer pan.

In the preferred embodiment, the latch member includes a lever arm fastener with a finger-like extension that slidably engages the mounting means, while the mounting means includes an extension integrally attached to the front of the drawer pan with a slot capable of receiving the finger-like extensions of the lever arm fastener.

Also in the preferred embodiment, the plate member includes a flange and the drawer pan includes a channel in which the flange is inserted.

Accordingly, this invention provides a drawer with a readily removable drawer front, so that the drawer pan may be thoroughly cleansed by full immersion without damage to the front panel.

Further, this invention provides an easily and inexpensively manufactured drawer which may be disassembled and reassembled numerous times without damage to the drawer front and/or pan.

And still further, the drawer fronts of this drawer do not have to be perfectly matched with their respective drawer frame for proper reassembly.

DESCRIPTION OF THE PREFERRED EMBODIMENT

Figure 1:
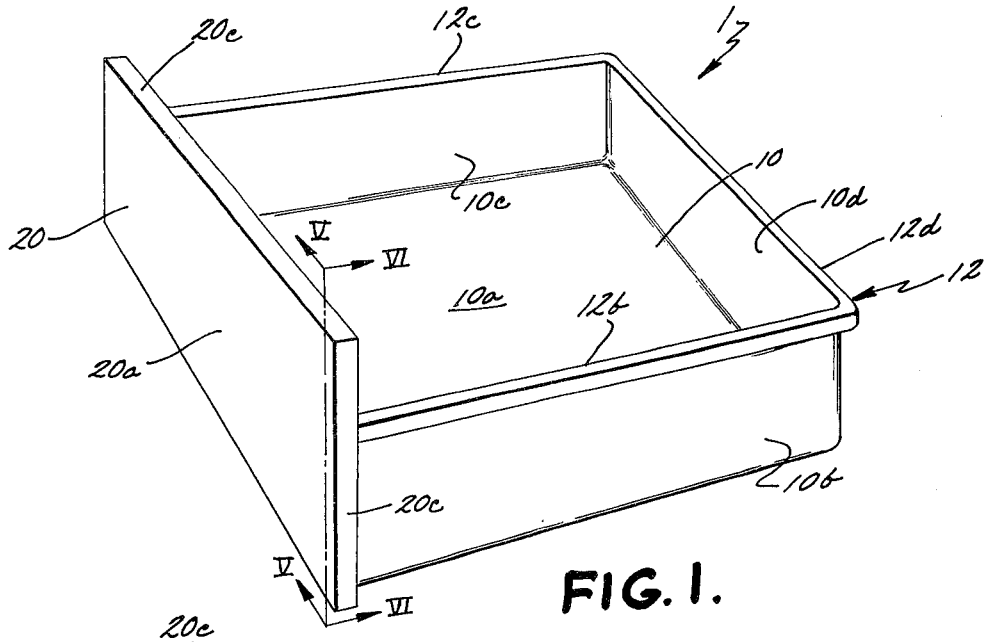
FIG. 1 is a front and side, elevational perspective view of the drawer.
Figure 2:
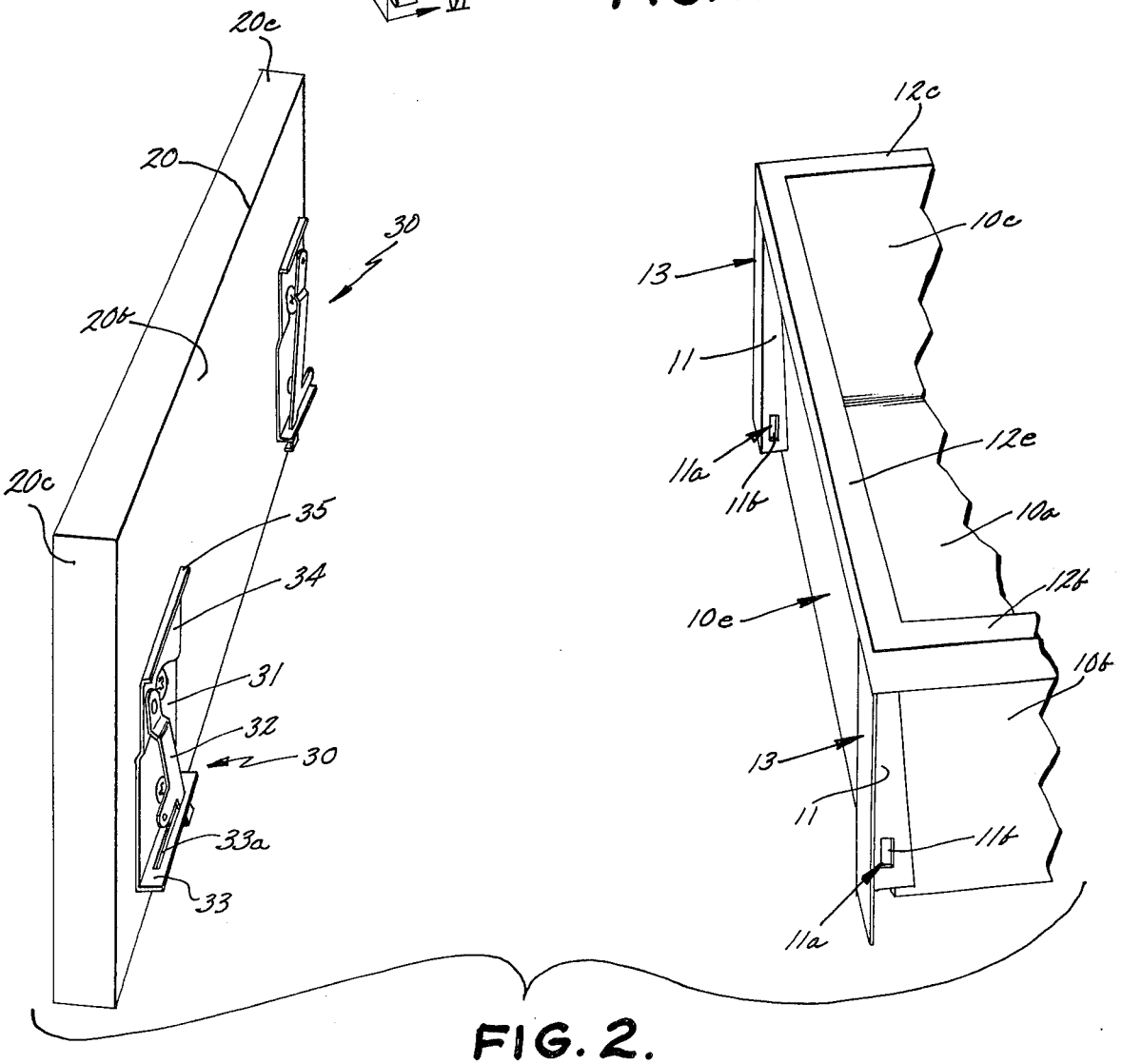
FIG. 2 is a side elevational, perspective view of the drawer fronting of FIG. 1 shown removed from the drawer pan which is partially shown in perspective.

Referring to FIGS. 1 and 2, the drawer 1 comprises a front panel 20 removably secured on a drawer pan 10. The panel 20 is secured to pan 10 by fasteners 30 which cooperate with extensions 11, channel 12*e*, and flanges 13 on the front panel 10*e* of drawer pan 10.

More specifically, as shown in FIG. 2, molded drawer pan 10 which is plastic or the like includes a bottom 10*a*, side walls 10*b* and 10*c*, rear wall 10d and front wall 10*e*. At the top of each respective wall section, a peripheral flange or channel element 12 is integrally molded thereon. Channel element 12*b* extends from side wall 10*b*, channel element 12*d* extends from rear wall 10*d*, etc.

Two forwardly protruding extensions 11 are integrally molded on the front wall 10*e* of drawer pan 10. Extensions 11 protrude generally perpendicular to wall 10d and have flanges 13 integrally molded thereon. Extensions 13 define a common planar surface with each other and with the downwardly directed portion of channel 12*e* to provide a suitable surface upon which front panel 20 abuts. Extensions 11 comprise therein rectangular slots 11*a* which, when aligned, define a plane generally parallel to the plane defined by flanges 13 and the downwardly directed portion of channel 12*e*.

A particular advantage in the abovedescribed molded drawer pan 10 is found in extending channel 12 peripherally around the upwardly open rim of drawer pan 10. As is discussed above, the downwardly directed portion of channel 12*e* is suitable for use as an abutting surface with front panel 20. Also, channel elements 12*b* and 12*c* attached to side walls 10*b* and 10*c* of drawer pan 10 may serve as a drawer rail without the need of further drawer mounting apparatus attached to the drawer pan. Further, channel 12*d* extending from rear wall 10*d* of drawer pan 10 may be useful as a spacer, when drawer pan 10 is placed in a cabinet or the like.

Front panel 20 is generally rectangular in shape and may be any one of a number of suitable decorative materials. In the preferred embodiment shown in FIGS. 1, 2, and 5, front panel 20 is comprised of a particle board whose front portion 20*a* is covered with a decorative facing.

Fasteners 30, shown in FIGS. 2–6, each comprise a plate member 31 which has lever arms 32 pivotally mounted thereon by means of pin or rivot 36. Plate member 31 is generally rectangular in shape and has at its upper portion a flange 34 integrally formed thereon. Flange 34 has two knob portions 34*a* on its lower part which comprise holes therein suitable for attaching a pin or other fastening means therethrough. Each flange 34 comprises a lip 35 which is directed outward from flange 34 in the same direction that flange 34 is directed outward from plate member 31.

A rotation guide 33 projects generally perpendicular from the lower portion of plate member 31 and is formed integrally thereon. Rotation guide 33 projects outwardly from body member 31 in the same direction that flange 34 and lip 35 similarly project. Rotation guide 33 comprises a rectangular-shaped slot 33*a* which extends generally along the length of rotation guide 33.

Figure 3:
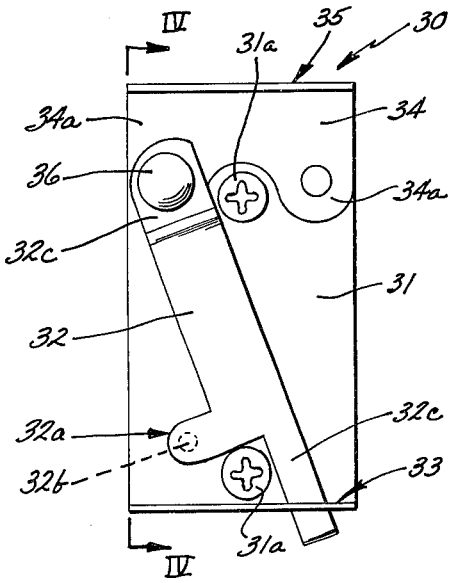
FIG. 3 is a close-up, rear view of the drawer fastener shown in FIG. 2.
Figure 6:
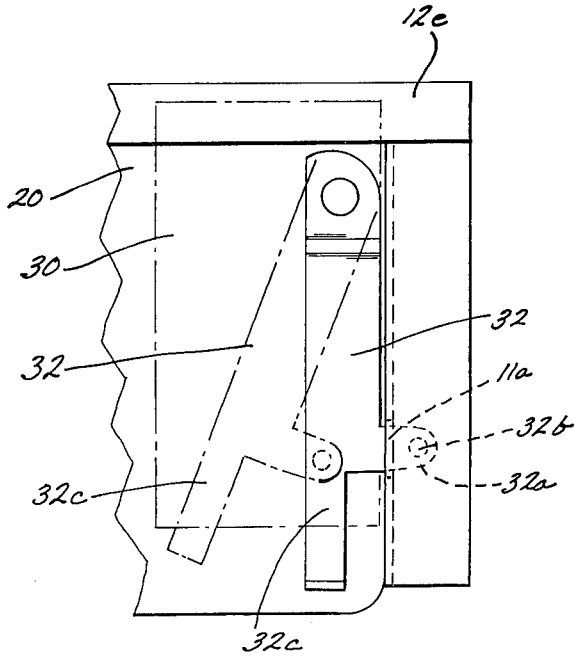
FIG. 6 is a partial, vertical, cross-sectional view of the drawer taken along plane VI—VI of FIG. 1.
Figure 4:
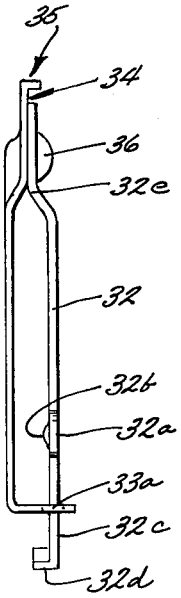
FIG. 4 is a side elevational view of the drawer front fastener of FIG. 3 taken along the plane IV—IV.

Referring particularly to FIGS. 3, 4, and 6, lever arm fastener 32 is elongated and rectangular in shape. A finger 32*a* protrudes generally perpendicular from each arm 32. Finger 32a comprises thereon a protrusion 32*b* which extends in a direction that is perpendicular to the plane of both lever arm 32 and finger 32*a*. A rotator 32*c* extends from arm 32 below finger 32*a*. Rotator 32*c* comprises, on its downwardmost end portion, a lip 32*d* which provides a flat gripping surface for facilitating manual rotation of rotator 32*c* and arm 32. The top portion 32*e* of arm 32 is inset with respect to the main portion of arm 32, so as to provide a suitable mounting surface for attaching arm 32.

Arm 32 is attached to plate member 31 by attaching mount portion 32*e* of arm 32 to protruding portion 34*a* of flange 34. Arm 32 is mounted on the protruding portion 34*a* in the preferred embodiment nearest the side edge of plate member 31 towards which finger 32*a* extends. Rotator extension 32*c* of arm 32 extends through slot 33*a* in rotator guide 33. The available path of rotation of arm 32 along pivot 36 is limited to the extent of slot 33*a* in guide 33.

Figure 5:
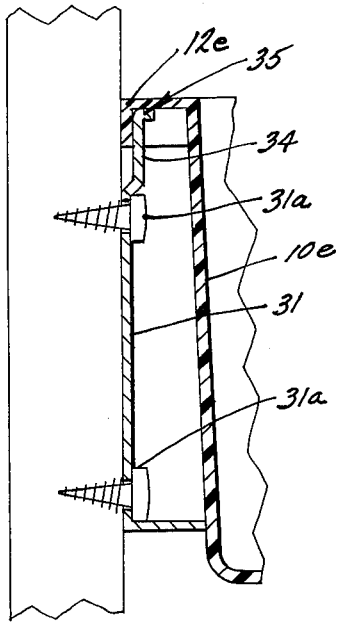
FIG. 5 is a partial, vertical, cross-sectional view of the drawer taken along plane V—V of FIG. 1.

As shown in FIGS. 2 and 5, fasteners 30 are attached to the rear portion 20*b* of front panel 20 by means of screws inserted through screw holes 31*a* of fastener body 31. Fasteners 30 are mounted in spaced relation from each other so as to be generally symmetric on rear portion 20*b* of panel 20.

When engaged in the position shown in FIG. 1 wherein front panel 20 is secured to drawer pan 10 by means of fasteners 30, each flange 34 is in slotted engagement with the downward protruding portion of channel 12*e* as shown in FIG. 5. As is further shown in FIG. 5, lip 35 extending from flange 34, abuts the upward portion of channel 12*e*. Fasteners 30 are positioned so as to be between extensions 11 along front wall 10*e*.

As seen at FIG. 6, after flanges 34 are nested in channel 12*e* as discussed above, front panel 20 is secured to front 10*e* of drawer pan 10 by rotating arms 32 in channel 33*a* outward along front panel 20. When so rotated, fingers 32*a* are inserted into slot 11*a* of extension 11. The protruding surface 32*b* on finger 32*a* is locked over the inwardmost wall portion 11*b* which forms slot 11*a* in extension 11.

As is apparent in FIG. 6, the bottom portion of finger 32*a* rides along the bottom portion of slot 11*a* so that as lever arms 32 are rotated into a locking position onto extensions 11, channel 12*e* of drawer 10 is forced downward on lip 35 of fastener 30. Similarly, rotating arms 32 ride against the outside of slot 33*a* (FIG. 4) so that as lever arms 32 are rotated into a locking position onto extension 11, front panel 20 is forced tight against flanges 13. Once so engaged, fingers 32*a* resist disengagement by any other means than deliberate rotation of arm 32.

When both arms 31 are rotated so that respective fingers 32*a* are snap fit into slots 11a, front panel 20 is rigidly secured to drawer pan 10 along flanges 13 thereof. As is readily apparent from the above description, spacing of fasteners 30 on front panel 20, positioning of extensions 11, flanges 13 and channel 12*e* and alignment of slots 11*a* is provided so that a relatively tight fit of front panel 20 on drawer pan 10 is accomplished. Alignment and positioning of these various elements is well within the mechanical ability of one skilled in the art.

OPERATION

When it is desired to attach front panel 20 to drawer pan 10, flanges 34 of each fastener body 31 are slid into the downward projecting portion of channel 12*e* on front wall 10*e* of drawer pan 10. When so positioned, rotator extension 32*c* is used to pivot arms 32 in a direction generally opposite to each other so that respective fingers 32*a* are slid into slots 11*a* of extension 11. Fingers 32*a* are pressed into slots 11*a* with sufficient force so as to snap fit protrusion 32*b* over wall 11*b* of slot 11*a*.

When it is desired to remove front panel 20 from drawer pan 10, arms 32 are rotated toward each other so as to disengage the snap fit of finger 32*a* in slot 11*a*. Front panel 20 is moved downward with respect to drawer 10 so as to slidably disengage flange 34 with downward protruding portion of channel 12*E*.

As should readily be apparent by the above description, fasteners 30 are accessible for attaching and removing front panel 20 from drawer pan 10. Thus, when it is desired to remove the door front, one must simply reach underneath front panel 20, contact rotator extension 32*c* and rotate arm 32 into the desired position. Because of this accessibility, drawer 1 does not have to be totally removed from a cabinet or the like in which it is mounted to remove front panel 20. Also, drawer 10 does not have to be emptied or have any of its contents displaced when it is desired to detach front panel 20.

It will be understood that various changes in the details, materials, steps, and arrangements of parts which have been herein described and illustrated in order to explain the nature of the invention, may be made by those skilled in the art within the principle and the scope of the invention as expressed in the appended claims.

The embodiments of the invention in which an exclusive property or privilege is claimed are defined as follows:

1. A drawer with a removable front panel comprising:
   a drawer pan having mounting means for mounting a panel on the front thereof;
   a front panel removably secured on said drawer pan; and
   fastening means attached to the back side of said drawer panel and invisible from the front side of said panel, said fastening means including a plate member secured to said panel and a latch member mounted on and movable with respect to said plate member and slidably engaging said mounting means for removably securing said panel to said pan; and gripping means positioned to be invisible from the front of said drawer for moving said latch member into engagement with said mounting means to secure said front panel on said drawer pan.

2. The drawer of claim 1 wherein said latch member includes a lever arm fastener with a finger-like extension, said finger-like extension slidably engaging said mounting means.

3. The drawer of claim 2 wherein said mounting means includes a slotted extension integrally attached to the front of said drawer pan, said slotted extension being capable of receiving said finger-like extensions.

4. The drawer of claim 3 wherein said drawer pan further includes a channel portion integrally attached to the front thereof and said plate member includes a flange, said flange being inserted into said channel to further secure said front panel on said drawer pan.

5. The drawer of claim 4 wherein said channel portion extends peripherally around the upwardly open rim of said drawer pan, said channel portion along the sides of said drawer pan serving as a drawer rail.

6. The drawer of claim 2 wherein said lever arm fastener is pivotally mounted on said plate member and said plate member further includes a means for limiting rotation of said lever arm fastener.

7. The drawer of claim 6 wherein said means for limiting the pivotal rotation of said lever arm fastener includes a slotted channel-like member extending perpendicularly from said plate member, said lever arm fastener projecting through said slotted channel-like member.

8. The drawer of claim 7 wherein said gripping means includes a rotator extension on said lever arm fastener, said rotator extension projecting through said slotted channel-like member and being accessible from the front of said front panel by reaching around the perimeter of said front panel, said rotator extension being invisible from said panel front.

9. The drawer of claim 1 wherein said drawer pan is comprised on one-piece molded plastic so as to allow immersible cleaning thereof.

10. A drawer with a removable front panel comprising:

a drawer pan having mounting means for mounting a panel on the front thereof;

a front panel removably secured on said drawer pan; and fastening means attached to the back side of said front panel and accessible from the front of said front panel, said fastening means including a plate member secured to said panel and a latch member mounted on and movable with respect to said plate member and slidably engaging said mounting means for removably securing said panel to said pan; and gripping means being accessible by reaching around the perimeter of said front panel from said panel front and invisible from said panel front for moving said latch member into engagement with said mounting means to secure said panel to said pan.

11. The drawer of claim 10 wherein said latch member includes a lever arm fastener, said lever arm fastener being pivotally mounted on said plate member and including a rotator extension, said extension being accessible from an edge of said front panel to allow rotation of said lever arm therefrom.

12. The drawer of claim 1 wherein said gripping means includes an extension on said latch member, said extension being located such that it extends adjacent an edge of said front panel along the back of said front panel.

13. The drawer of claim 10 wherein said gripping means includes an extension on said latch member, said extension being located such that it extends adjacent an edge of said front panel along the back of said front panel.

* * * * *